United States Patent [19]

Tomoda

[11] 4,410,483

[45] Oct. 18, 1983

[54] NEUTRON DETECTOR FOR USE WITHIN NUCLEAR REACTOR

[75] Inventor: Toshimasa Tomoda, Amagasaki, Japan

[73] Assignee: Mitsubishi Denki Kabushiki Kaisha, Tokyo, Japan

[21] Appl. No.: 271,880

[22] Filed: Jun. 9, 1981

[30] Foreign Application Priority Data

Jun. 26, 1980 [JP] Japan ..... 55-88152

[51] Int. Cl.[3] ..... G21G 17/00

[52] U.S. Cl. ..... 376/154

[58] Field of Search ..... 376/154, 255

[56] References Cited

U.S. PATENT DOCUMENTS 2,809,313 10/1957 Baer et al. ..... 376/154

2,845,560 7/1958 Curtis et al. ..... 376/154

*Primary Examiner*—Sal Cangialosi

*Attorney, Agent, or Firm*—W. G. Sutcliff

[57] ABSTRACT

An improved long operating lifetime ionization chamber type neutron detector for use within a nuclear reactor. The chamber contains uranium U-235 as the neutron sensitive material and helium or argon fill gas. The atom rate of U-235 to fill gas is from 0.45 to 1.8 for helium, and 2.3 to 9 for argon.

3 Claims, 3 Drawing Figures

NEUTRON DETECTOR FOR USE WITHIN NUCLEAR REACTOR

BACKGROUND OF THE INVENTION

This invention relates to neutron detectors designed for use within a nuclear reactor, and is more specifically related to an ionization chamber type neutron detector for use within a nuclear reactor.

DESCRIPTION OF THE PREFERRED EMBODIMENT

Figure 1:
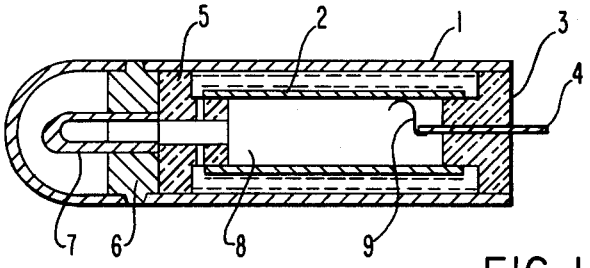
FIG. 1 is a cross sectional view of a neutron detector structure of the prior art.

An example of the prior art type neutron detector is shown in FIG. 1. A cylindrical outer electrode 1 is disposed concentrically about a cylindrical inner electrode 2 with a constant radial spacing therebetween. At one end of electrodes 1 and 2 a ceramic seal 3 is hermetically sealed to and supports these electrodes. An electrical lead-in 4 is hermetically sealed through the ceramic seal 3. A ceramic body 5 supports the other ends of outer electrode 1 and inner electrode 2. An end plate 6 is hermetically sealed to the outer electrode 1, and is spaced axially from the ceramic body 5. An exhaust and gas fill tubulation 7 is hermetically sealed through the end plate 6.

A fill gas 8 is disposed within the sealed chamber defined by outer electrode 1, ceramic seal 3 with lead-in 4, and end plate 6 with tubulation 7 therethrough. An electrical lead wire 9 electrically connects the inner electrode and the lead-in 4. An exhaust and gas fill aperture is provided through ceramic body 5. An enriched uranium layer is disposed on one or both of the inner wall of the outer electrode 1 and the outer wall of the inner electrode 2. The enriched uranium typically has a concentration of about 95% U-235.

The functioning of the detector is as follows. Direct current voltage is applied between the inner electrode 2 and the outer electrode 1. When the detector is disposed in a neutron flux field, neutrons pass through the outer electrode 1 and interact with the enriched uranium deposited on an electrode surface inducing nuclear fission and yielding fission fragments. These resulting fission fragments have high kinetic energy and ionize gas fill molecules upon passage through the fill gas between the outer and inner electrodes. Specifically, the space or chamber defined by the outer electrode forms an ionization chamber. The ions and electrons produced are collected on the corresponding electrodes according to their respective charge, thereby generating an electric current. The current generated is proportional to the neutron flux at the neutron detector location, and thus the neutron flux is measured by measuring this generated current.

The ionization chamber device shown in FIG. 1 is generally combined with a coaxial signal cable with inorganic insulating material for the measurement of neutron flux within a reactor. The ionization chamber device generally has an outside diameter of 4–6 mm, with the spacing between the outer and inner electrodes in the range of 0.3–0.5 mm. The length of the inner electrode is generally about 25 mm. The fill gas is helium or argon. The amount of enriched uranium is about 2 mg of U-235. In addition, in order to control the temperature increase within the ionization chamber due to $\gamma$ ray heating which is intense within a reactor core, the inner electrode is made cylindrical instead of being a solid member.

The neutron sensitivity S of the ionization chamber is proportional to the product of the number of U-235 atoms $N_u^o$ in the enriched uranium layer, the number of fill gas atoms Ng, and the relative energy loss by the nuclear fission fragments through interaction with the fill gas $\xi$.

However, the number of U-235 atoms is reduced with time of use of the detector according to the following equation.

$$N_u = N_u^o e^{-\sigma\phi t}$$

where $\sigma$ is the nuclear fission cross section of U-235, $\phi$ is the neutron flux, and t is the time of usage in the flux. In the case of a PWR, i.e. pressurized water reactor, the value of $\sigma$ is about 300 barns with respect to the reactor core flux spectrum. The value of $\phi$ is about $1\times10^{14}$ nu, and when this detector is in use continuously for one year, $$\sigma\phi t = 0.9, \text{ and}$$

$$N_u = 0.4\ N_u^o$$

Also, the number of U-235 atoms is reduced to less than half the initial amount. The nuclear fission fragments pass through various decay paths, depending on the variety of nuclei, or fission fragments initially created and eventually they are converted to stable rare gas atoms. However, the effect of this rare gas on the neutron sensitivity has been considered to be low, and thus it has not been previously utilized. Therefore, the neutron sensitivity is reduced nearly proportional to the reduction in the amount of the U-235 atoms, and the life of the previous neutron detector has been limited as a result of this reduction in sensitivity.

The purpose of this invention is the elimination of the above-mentioned disadvantage. The purpose of this invention is to provide a neutron detector for use within nuclear reactors having a low reduction in the neutron sensitivity even with a reduction in the amount of U-235 atoms. A neutron detector satisfying the objectives described above is provided by optimizing the ratio of the number of fill gas atoms to the number of U-235 atoms in the enriched uranium sensing layer in this invention.

Figure 2:
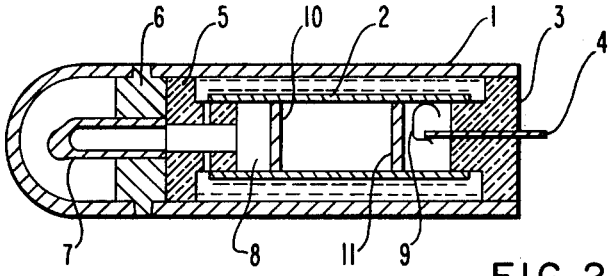
FIG. 2 is a cross sectional view similar to that of FIG. 1, but showing an embodiment of a neutron detector of the present invention for use within a nuclear reactor.

One practical example of this invention is explained using a figure as follows. In the practical example of this invention illustrated in FIG. 2, there is only one difference in the structure of the inner electrode from the detector shown in FIG. 1, and the rest is practically the same. The fill gas is He. Discs 10 and 11 are hermetically sealed within the inner electrode near the opposed ends of this electrode. The gas within the space formed by the two discs and the inner electrode may be any gas, but it is not mixed with the He gas present in the space between the two electrodes. Because of this construction, the ratio of the number of U-235 atoms in the enriched uranium layer to the number of fill gas He atoms is 3/2.2.

Figure 3:
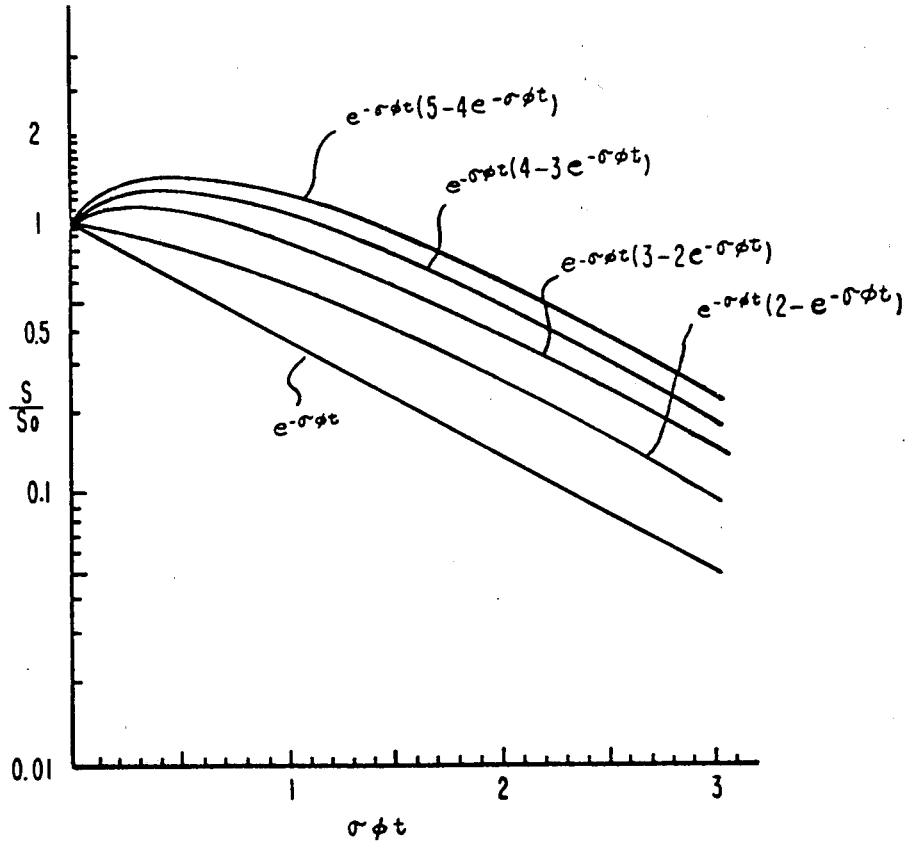
FIG. 3 is a graph showing the variation of neutron sensitivity as a function of the product of time t, neutron flux $\phi$, and neutron cross section $\sigma$.

As a result of nuclear fission of the U-235 produced by interaction with thermal neutrons, Kr and Xe are formed as stable rare gases, and the yields $\eta$ of these gases are about 3.6% and 22% respectively. About half of these stable rare gases escapes into the gas ionization chamber between the electrodes, but most of it is adsorbed by the electrode. The remaining half moves toward the bottom of the enriched uranium layer and remains adsorbed on the electrode. However, the depth these gases reach is extremely shallow, since the flight path of the nuclear fission fragments is short, and at the sametime, the temperature surrounding the detector within the reactor core is high; thus most of the gas adsorbed by the electrode seeps out into the gas ionization chamber. Kr and Xe in the gas ionization chamber contribute to increasing the neutron sensitivity S proportional to the amount of their energy discharge capacity $\xi$ against fission fragments. Therefore, the neutron sensitivity is:

$$\begin{aligned} S &= sN_u(\xi_g N_g + \xi_{Kr}N_{Kr} + \xi_{Xe}N_{Xe}) \\ &= sN_u^o e^{-\sigma\phi t}\xi_g N_g\{1 + N_u^o/\xi_g N_g(\xi_{Kr}\eta_{Kr} + \xi_{Xe}\eta_{Xe}) \\ &\quad (1 - e^{-\sigma\phi t})\} \\ &= sN_u^o \xi_g N_g e^{-\sigma\phi t}\{1 + A \cdot N_u^o/N_g(1 - e^{-\sigma\phi t})\} \\ &= S^o e^{-\sigma\phi t}\{1 + A\, N_u^o/N_g(1 - e^{-\sigma\phi t})\} \end{aligned}$$

where $A = 1/\xi_g(\xi_{Kr}\eta_{Kr} + \xi_{Xe}\eta_{Xe})$ $S^0 = sN_u^o\xi_g N_g$ is the neutron sensitivity initially, and if $\xi_{He} = 1$ then $\xi_{Ar} = 5$, $\xi_{Kr} = 7$, and $\xi_{Xe} = 9$, therefore $A = 2.2$ if the fill gas in the neutron detector is He, and $A = 0.44$ in the case of Ar. In the example described above, the number of He atoms $N_g$ is 2.2/3 times the number of U-235 atoms, and thus if the time of usage is variable, the variation of the sensitivity S is represented by the curve $S/S_o = e^{-\sigma\phi t}(4 - 3\sigma - \sigma\phi t)$ as shown in FIG. 3. FIG. 3 also shows the situation of $S/S_o = e^{-\sigma\phi t}$ in the previous case with the assumption that $N_g$ is relatively larger than $N_u^o$.

As described above, the value of $\sigma\phi t$ is about 0.9 in the case of the previous detector used continuously for one year in a PWR reactor and the sensitivity of the detector is reduced to about 15% of the original level. For a detector of the present invention which is in use in the same reactor for two years ($\sigma\phi t = 1.8$), the sensitivity of the detector is only reduced to 60% of the original level, and therefore the life of the detector is drastically improved by his invention.

The above discussion was carried out in the case where the ratio of $N_u^o$ to $N_g$ was 3/2.2, or stated conversely the ratio of $N_g$ to $N_u^o$ was 2.2/3. However, it is easily determined that the sensitivity variation accompanied by the use of the detector is significantly improved if the ratio is within the range of 1/2.2–4/2.2 as shown in FIG. 3, which ratio can be restated as 0.45 to 1.8.

In addition, the same effect is apparently obtainable in the case of Ar used as the fill gas if the ratio of $N_u^o$ to $N_g$ is within the range of 1/0.44–4/0.44, which ratio can be restated as 2.3 to 9.

In the case of the practical example described above, an attempt was made to increase the ratio of $N_u^o$ to $N_g$ by installing the two discs hermetically sealed within opposed ends of the inner electrode. However, it is also possible to reduce the space other than the effective ion chamber portion used to generate the ionization current proportional to the neutron flux between the two electrodes by having a solid substance within the cylindrical inner electrode.

As described above, this invention is effective in keeping the variation of the neutron sensitivity low in the case of long-term use of the neutron detector. The ratio of the number of U-235 atoms in the enriched uranium layer deposited on the electrode surface to the number of He fill gas atoms is restricted within the range of 0.45–1.8 for a neutron detector using He as an ionization fill gas. Furthermore, for a neutron detector using Ar as an ionization fill gas, the ratio of the number of U-235 atoms to the number of Ar fill gas atoms is kept within the range of 2.3–9.

I claim:

1. In an ionization chamber type neutron detector for use within a nuclear reactor, which detector utilizes enriched uranium U-235 as the neutron sensitive substance within the chamber and helium or argon as the ionizable fill gas within the chamber, the improvement comprising providing an atom ratio of U-235 to ionizable fill gas of 0.45 to 1.8 for helium fill gas, and 2.3 to 9 for argon fill gas.

2. The neutron detector set forth in claim 1, wherein the ionizable fill gas is helium, and the preferred atom ratio of U-235 to helium is 1.36.

3. The neutron detector set forth in claim 1, wherein the detector comprises an outer cylindrical electrode and a coaxially disposed inner cylindrical electrode, with the ionization chamber defined between these electrodes, with disc seal members sealed within opposed ends of the inner cylindrical electrode to minimize the ionization chamber fill gas volume.

* * * * *